US006467899B1

(12) United States Patent
Kawabata et al.

(10) Patent No.: US 6,467,899 B1
(45) Date of Patent: Oct. 22, 2002

(54) IMAGE FORMING METHOD

(75) Inventors: Kouya Kawabata; Akio Miyamoto, both of Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 9 days.

(21) Appl. No.: 09/637,995

(22) Filed: Aug. 15, 2000

(30) Foreign Application Priority Data

Aug. 19, 1999 (JP) ..... 11-232508

(51) Int. Cl.[7] ..... B41J 2/01
(52) U.S. Cl. ..... 347/103
(58) Field of Search ..... 347/103, 120, 347/123, 111, 159, 141, 151, 55, 127, 128, 17, 154

(56) References Cited

FOREIGN PATENT DOCUMENTS

| | | |
|---|---|---|
| EP | 0883026 A1 | 12/1998 |
| JP | 2632087 | 4/1997 |
| JP | 11-70633 | 3/1999 |
| JP | 11-198421 | 7/1999 |

OTHER PUBLICATIONS

Patent Abstract of Japan 11198421 Jul. 27, 1999.
Patent Abstract of Japan 2632087 Apr. 25, 1997.

*Primary Examiner*—Raquel Yvette Gordon
(74) *Attorney, Agent, or Firm*—Sughrue Mion, PLLC

(57) ABSTRACT

An image forming method which widens the range of materials usable for an image forming method that employs an ink-jet technique and yields an image with high image quality and high homogeneity. An image pattern forming material containing an adhesive material is discharged onto a transfer layer surface of an image transfer material or onto an image receiving layer surface of an image receiving material, and the image pattern forming material is formed in an image pattern. The transfer layer surface of the image transfer material is closely contacted with the image receiving layer surface of the image receiving material. The image transfer material is peeled off from the image receiving material and portions of the transfer layer are stripped off in an image pattern from the image transfer material by the image pattern forming material. Thus, the image is formed on the image receiving material.

13 Claims, 2 Drawing Sheets

IMAGE FORMING METHOD

BACKGROUND OF THE INVENTION

1. Field of the Invention

The present invention relates to an image forming method using a stripping transfer technique which utilizes a process in which an adhesive material is formed in an image pattern, and particularly to an image forming method which transfers an image transfer material to an image receiving material through the adhesive material to form an image.

2. Description of the Related Art

A stripping transfer technique is one technique for forming an image on a receiving member such as paper or the like. The stripping transfer technique is a technique in which a transfer member (toner sheet), in which a transfer layer including a pigmental toner which serves as a transfer material is provided on a surface of a substrate, is superposed on a receiving member (receiving sheet) such as paper or the like. A latent image is formed in an image pattern on the toner sheet. The toner formed in an image pattern is transferred onto the receiving sheet, and the image is formed on the receiving sheet. This stripping transfer technique includes forming a latent image in an image pattern with heat provided by a thermal head from a back surface side of a substrate of a toner sheet; sublimating a toner to transfer the same to a receiving sheet; melting a heat-meltable toner and fusing the same to a receiving sheet; generating adhesiveness at an image receiving layer of a receiving sheet by heating and fixing toner on a toner sheet to the image receiving layer; and the like.

Also, as a method for forming an image on a receiving sheet, there is a method which employs an ink-jet technique in which ink is discharged as droplets by mechanical energy, without heat recording. In the ink-jet technique, an ink head is formed by: a plurality of linearly disposed nozzle holes; an independent discharging chamber which communicates with these nozzle holes and in which a portion of a wall at one side of the chamber serves as a diaphragm; a piezoelectric element mounted on the diaphragm; and a common ink cavity which supplies ink to the discharging chamber. The diaphragm is mechanically flexed by application to the piezoelectric element of pulse voltages based on image data. The volume of the discharging chamber increases and decreases due to diaphragm flexing. Thus, momentary changes in pressure within the discharging chamber are used to discharge droplets from the nozzle holes, and an image is formed on a receiving sheet.

One image forming method using this ink-jet technique is disclosed in Japanese Patent No. 2632087. This is a method for forming a photo-cured image by ejecting a substance which enhances or lowers photo-curing sensitivity from an ink-jet head onto a photo-curable film in a patterned form, and then performing exposure of the entire surface of the photo-curable film.

Further, in Japanese Patent Application Laid-Open (JP-A) No. 11-70633, a method is disclosed in which droplets of a cross-linking agent are applied to a recording layer including a cross-linkable material in an image-wise manner by an ink-jet technique. Portions of the recording layer where the cross-linking agent has been applied are cross-linked and cured. Portions of the material that were not cross-linked are removed by washing and an image is formed.

However, the methods recited in Japanese Patent No. 2632087 and Japanese Patent Application Laid-Open (JP-A) No. 11-70633 are methods for causing changes in the physical properties of a film on which an image is formed in an image pattern by the ink-jet technique. Therefore, there is a problem in that a material which exhibits such a change in physical properties must be selected, such that applicable materials are limited. Further, in the method recited in Japanese Patent Application Laid-Open (JP-A) No. 11-70633, a so-called liquid developing process is required, in which uncross-linked portions of the cross-linkable material forming the recording layer are removed by washing. Therefore, there is a problem in that a cross-linkable material and an image receiving material which can withstand the liquid processing must be used, such that applicable materials are further limited. Further, there are problems in that it is impossible to comply with requests for reducing processing and materials such as cleaning liquids and the like which are used in processing.

SUMMARY OF THE INVENTION

The present invention was made in consideration of the above-described problems. In other words, an object of the present invention is to widen the range of materials which are applicable for an image forming method that employs an ink-jet technique, and to enable reduction of developing process steps or the like and omission of a cleaning liquid and the like used in those steps. Also, an object of the present invention is to provide an image forming method using a stripping transfer technique which performs stripping and transfer efficiently and provides an image which has high image quality and high homogeneity.

As a result of keen study, the inventors of the present invention found an image forming method, as described below, using an image pattern forming material containing an adhesive material which neither affects the performance of discharge at a nozzle of an ink-jet head nor deteriorates droplet formability.

A first aspect of the present invention is a method of forming an image comprising the steps of: (a) discharging an image pattern forming material containing at least one kind of adhesive material in accordance with image data onto one of a transfer layer surface of a transfer material and an image receiving layer surface of an image receiving material; (b) closely contacting the transfer layer surface and the image receiving layer surfaces against one another; and (c) peeling off one surface from the other and portions of the transfer layer along therewith due to the effect of the adhesive material, thereby forming an image on the image receiving material.

A second aspect of the present invention is a method of forming an image according to the first aspect of the present invention, wherein the adhesive: material is dispersed in solid form.

A third aspect of the present invention is a method of forming an image according to the first aspect of the present invention, wherein the adhesive material includes a material having adhesiveness.

A fourth aspect of the present invention is a method of forming an image according to the first aspect of the present invention, wherein the adhesive material includes a thermoplastic material, which softens when heated and becomes adhesive.

A fifth aspect of the present invention is a method of forming an image according to the fourth aspect of the present invention, wherein the thermoplastic material has a glass transition point, the method further comprising the step of heating to a temperature in a range at least equal to the glass transition point and to no more than 100 degrees C. greater than the glass transition point.

A sixth aspect of the present invention is a method of forming an image according to the fifth aspect of the present invention, wherein the step of heating is performed during the step of close contacting.

A seventh aspect of the present invention is a method of forming an image according to the fourth aspect of the present invention, wherein the adhesive material includes at least one copolymer resin selected from the group consisting of ethylene-vinyl acetate copolymer resins, ethylene-methacrylic acid copolymer resins, and olefin copolymer resins.

An eighth aspect of the present invention is a method of forming an image according to the first aspect of the present invention, wherein the adhesive material comprises from 0.1 to 100 percent by weight of the image pattern forming material.

A ninth aspect of the present invention is a method of forming an image according to the first aspect of the present invention, wherein the transfer layer is formed on one surface or both surfaces of a substrate, and the transfer layer contains polyvinyl butyral.

A tenth aspect of the present invention is a method of forming an image comprising the steps of: (a) disposing a substance in accordance with image data on a first material to thereby form a first image on the first material; (b) adhering portions of the first material in accordance with the first image, to a second material; and (c) transferring said portions from one material to the other material to thereby form a second image, which is a visible image, on said other material.

An eleventh aspect of the present invention is a method of forming an image according to the tenth aspect of the present invention, wherein the step of adhering portions includes close contacting the first material against the second material and applying heat.

A twelfth aspect of the present invention is a method of forming an image according to the tenth aspect of the present invention, wherein the step of transferring said portions, includes peeling off the one material from the other material.

A thirteenth aspect of the present invention is a method of forming an image according to the tenth aspect of the present invention, wherein the step of disposing a substance, includes providing a substance comprising a thermoplastic material, which softens and becomes adhesive when subjected to heat.

A fourteenth aspect of the present invention is a method of forming an image according to the tenth aspect of the present invention, wherein the step of disposing a substance, includes providing a substance comprising at least one adhesive material.

A fifteenth aspect of the present invention is a method of forming an image comprising the steps of: (a) disposing a substance including at least one adhesive material in accordance with image data on a first material to thereby form a first image on the first material; (b) close contacting the first material against the second material; and (c) peeling off one material from the other and portions from one material in accordance with the first image, to thereby form a second image, which is a visible image, on one of the materials.

DESCRIPTION OF THE PREFERRED EMBODIMENTS

The present invention will be described in detail below.

Image Forming Method

The method of the present invention will be described with reference to FIGS. 1A through 1D and 1A' through 1D'.

Figure 1A:
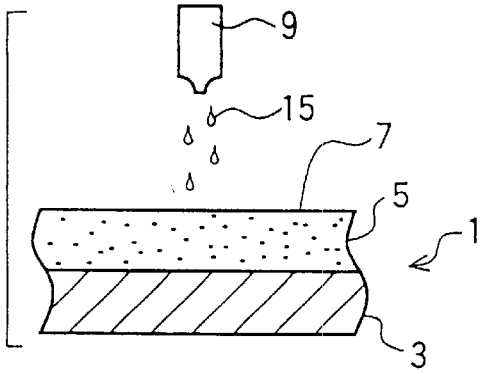
FIGS. 1A through 1D and 1A' through 1D' are drawings describing an image forming method of the present invention.
Figure 1A:
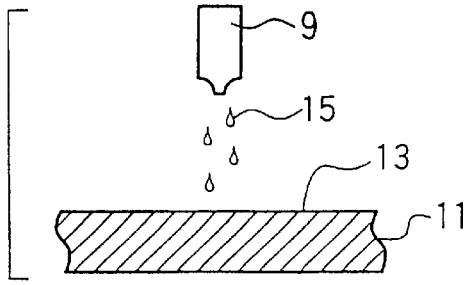
Figure 1B:
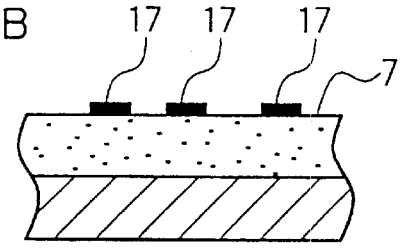
Figure 1B:
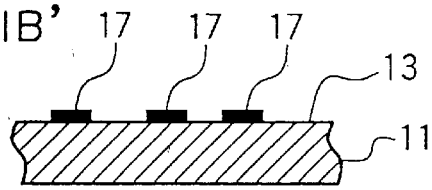

In the method of the present invention, initially, an image pattern forming material which contains an adhesive material is discharged from a droplet discharging head 9 onto either a surface 7 of a transfer layer 5 of an image transfer material 1 or an image receiving layer surface 13 of an image receiving material 11, to be formed in an image pattern. FIG. 1A is a drawing in which an image pattern forming material 15 is discharged onto the transfer layer surface 7 of the image transfer material 1, and. FIG. 1A' is a drawing in which the image pattern forming material 15 is discharged onto the image receiving layer surface 13 of the image receiving material 11. For the droplet discharging head 9, one of a variety of ink-jet heads which have been used in conventional image forming methods that use ink-jet techniques can be used. The image pattern forming material 15 contains the adhesive material in solid form. The image pattern forming material 17 is formed in an image pattern on the transfer layer surface 7 (FIG. 1B) or the image receiving layer surface 13 (FIG. 1B'), undergoing processes such as drying or the like, if desired.

Figure 1C:
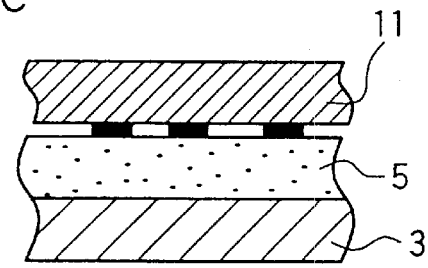
Figure 1C:
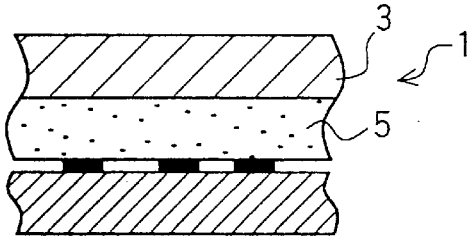

Next, the image transfer material 1 and the image receiving material 11 are closely contacted to each other through the image pattern forming material 17 which has been formed in an image pattern. (FIGS. 1C and 1C'). The adhesive material contained in the image pattern forming material 15 has adhesiveness and, by pressure applied to the image transfer material 1 and the image receiving material 11, the transfer layer surface 7 of the image transfer material 1 and the image receiving layer surface 13 of the image receiving material 11 can be closely adhered to each other through the image pattern forming material 17. Further, the adhesive material contained in the image pattern forming material 15 may be a thermoplastic material. In this case, by heating one or both of the transfer layer surface 7 and the image receiving layer surface 13 before, while or after the image transfer material 1 is closely contacted to the image receiving material 11, the transfer layer surface 7 of the image transfer material 1 and the image receiving layer surface 13 of the image receiving material 11 are adhered to each other by the adhesive material.

Figure 1D:
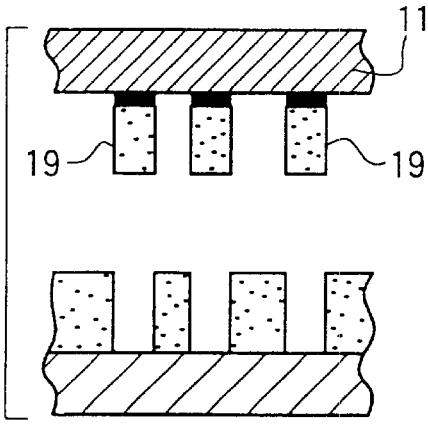
Figure 1D:
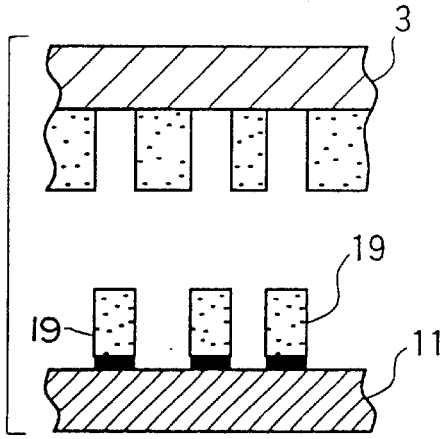

After adhesion, the image transfer material 1 and the image receiving material 11 are peeled apart (FIGS. 1D and 1D'). At this time, portions 19 of the transfer layer 5 of the image transfer material 1, which portions have been adhered to the image receiving layer surface by the image pattern forming material which was formed in an image pattern, are stripped off and transferred to the image receiving layer surface 13 of the image receiving material 11. In other words, the image pattern forming material 17 which was formed in an image pattern and the portions of the transfer layer 5 which have been stripped off from the substrate 3 of the image transfer material 1 are disposed in that order on the image receiving layer surface 13 of the image receiving material 11. These portions 19 of the transfer layer 5, which have been formed in an image pattern and transferred to the image receiving layer surface 13, form an image. Thus, the present invention forms an image.

Next, materials which are used for the image forming method of the present invention will be described.

Image Pattern Forming Material

The image pattern forming material is a material which contains an adhesive material. The image pattern forming material may be made by dispersing the adhesive material in solid form. A dispersion medium is selected in view of dispersibility of the adhesive material, discharge characteristics of the image pattern forming material when discharged from the droplet discharging head, and droplet forming characteristics of the image pattern forming material. Further, it is also preferable to select the dispersion medium in view of affinity thereof with the material to which the dispersion medium is applied, such as the transfer layer, the image receiving layer or the like, after the dispersion medium is discharged (for example, in the case in which the image pattern forming material is formed in an image pattern on the transfer layer of the image transfer material, affinity between the image pattern forming material and a coloring material contained in the transfer layer is considered, and, in the case in which the image pattern forming material is formed in an image pattern on the image receiving layer surface, affinity between the image pattern forming material and the image receiving layer surface is considered). Examples of the dispersion media include water, water to which a small amount of alcohol is added, water to which a surfactant is added, and the like.

Adhesive Material

The adhesive material used in the present invention contains at least a material with adhesiveness or a thermoplastic material which softens and generates adhesiveness when heated. Of such adhesive materials, those which do not impair the discharge characteristics and droplet forming characteristics of the image pattern forming material to be discharged from the ink-jet head are preferable.

Among the materials with adhesiveness, materials having adhesiveness at ordinary temperature or near ordinary temperature are preferable because the range of materials which can be used for the image transfer material and the image receiving material can be widened. Examples of such adhesive materials include polyacrylic acid esters, polymethylvinylether, polyvinylidene chloride, chloroprene rubbers and nitrile rubbers, and the like.

In a case in which a thermoplastic material, which softens and generates adhesiveness when heated, is used as the adhesive material, the heat to be applied to the thermoplastic material depends on the glass transition point (Tg) of the thermoplastic material. The thermoplastic material may be heated to temperatures from Tg+0° C. to Tg+100° C., preferably from Tg+0° C. to Tg+30° C., and more preferably from Tg+0° C. to Tg+10° C. As described above, a material whose Tg is close to ordinary temperature is preferable.

In the case in which a thermoplastic material, which softens and generates adhesiveness when heated, is used as the adhesive material, it is preferable for either or both of the image transfer material and the image receiving material to have heat resistance. In this case, if a process of applying heat to the thermoplastic material is provided at or after the time that the image transfer material is closely adhered to the image receiving material, it is preferable for both the image transfer material and the image receiving material to have heat resistance. On the other hand, if a process of applying heat to the thermoplastic material is provided before the image transfer material is closely adhered to the image receiving material, it is sufficient for one of the image transfer. material and the image receiving material to have heat resistance. In this case, the materials for the image transfer material and the image receiving material can be selected such that one of the image transfer material and the image receiving material has heat resistance. Thus, the range of selectable materials need not be limited any more than necessary. Further, it is preferable to use a thermoplastic material having a low Tg, such that the heat resistance of the image transfer material and the image receiving material need not be considered.

Examples of thermoplastic materials which can be used for the present invention include vinyl acetate, polyvinyl alcohol, polyvinyl acetal, polyvinyl chloride, ethylene-vinyl acetate copolymer resin, ethylene-methacrylic acid copolymer resin, olefine copolymer resin, and the like.

Ethylene-vinyl acetate copolymer resin, ethylene-methacrylic acid copolymer resin, olefine copolymer resin, and the like, are particularly preferable.

Further, in the present invention, a homogeneous or heterogeneous mixture;of two or more of the above-described materials with adhesiveness and the above-described thermoplastic materials can be used as the adhesive material.

As described above, the adhesive material may be dispersed in solid form in the image pattern forming material.

If the total weight of the image pattern forming material is considered to be 100 wt %, the amount of the adhesive material contained in the image pattern forming material is from 0.1 to 100 wt %, preferably from 0.1 to 10 wt %, and more preferably from 0.1 to 5 wt %.

Image Transfer Material

An image transfer material is formed by a transfer layer provided on a substrate. The transfer layer may be provided on just one surface of the substrate or provided on both surfaces of the substrate. Either of these structure can be employed, depending on objectives.

Substrate of Image Transfer Material

There is no particular limitation to materials for the substrate of the image transfer material. A variety of materials can be used, depending on objectives. Examples of preferable materials for the substrate include synthetic resin materials such as polyethylene terephthalate; polyethylene-2,6-naphthalate; polycarbonate; polyethylene; polyvinyl chloride; polyvinylidene chloride; polystyrene; styrene-acrylonitrile copolymer resin; and the like. Of these, a biaxially oriented polyethylene terephthalate is preferable in view of mechanical strength and dimensional stability with regard to heat.

In a case in which a thermoplastic material is used as the adhesive material, depending on the processes that are to be performed, it is preferable to use a material with heat resistance for the substrate of the image transfer material.

At the substrate, in order to improve adhesion (and/or strippability) of the transfer layer provided on the substrate, it is preferable to perform at least one of surface roughening processing for the substrate surface and application of one, or two or more, undercoat layers. Examples of the surface roughening processing for the substrate surface include a glow discharge process, a corona discharge process, and the like. Examples of materials for each undercoat layer include styrene, styrene-butadiene copolymer, gelatin, and the like. Total thickness of the under coat layer(s) is usually from 0.01 to 2 $\mu$m. Moreover, on a surface of the substrate which is opposite to the surface side at which the transfer layer is provided, a variety of functional layers such as a releasing layer and the like can be provided, or surface processing can be performed, as necessary.

Transfer Layer of Image Transfer Material

The transfer layer usually contains a pigment for forming an image. If a color image is to be formed, the transfer layer contains at least a pigment to be transferred to the image receiving material to form a colored image. With regard to enabling satisfactory pigment dispersibility, it is preferable for the transfer layer to contain polyvinyl butyral. Further, the transfer layer also contains a binder resin for forming the layer, and other components, as desired. Further, in the present invention, the transfer layer is not necessarily limited to being a color transfer layer. For example, in a case in which the transfer layer is used in forming a planographic printing plate or the like, it may be a colorless resin layer or the like.

Pigments are generally classified broadly into organic pigments and inorganic pigments. Organic pigments have characteristics which are particularly excellent for transparency of a coating film and the like, and inorganic pigments have characteristics which are generally excellent for masking, and the like. Thus, appropriate pigments can be selected in response to applications. In a case in which the image transfer material relating to the present invention is used as a color proof for printing color correction, an organic pigment conforming to or having tones close to yellow, magenta, cyan and black, which colors are generally used for printing inks, is suitably used. Besides, the aforementioned pigments, metal powders, fluorescent pigments, and the like can be used. Examples of pigments that are suitable for use include azo-pigment, phthalocyanine pigment, anthraquinone pigment, dioxazine pigment, quinacridone pigment, isoindolinone pigment, and nitro pigment. Examples of pigments that can be used for the transfer layer are listed below, divided into hue categories. Pigments that can be used are not limited to these examples.

1) Yellow Pigment

Hansa-Yellow G, Hansa-Yellow 5G, Hansa-Yellow 10G, Hansa-Yellow-A, Pigment Yellow L, Permanent Yellow NCG, Permanent Yellow FGL, Permanent Yellow HR 2) Red Pigment Permanent Red 4R, Permanent Red F2R, Permanent Red FRL, Lake Red C, Lake Red D, Pigment Scarlet 3B, Bordeaux 5B, Alizarin Lake, Rhodamine Lake B 3) Blue Pigment Phthalocyanine Blue, Victoria Blue Lake, Fast Sky Blue 4) Black Pigment

Carbon Black

As a binder resin for the transfer layer, a resin having good adhesiveness with the adhesive material to be used and a softening point from 40° C. to 150° C. can be used. In a case in which a thermoplastic material is used as the adhesive material, depending on the processes to be performed, it is preferable that a material having heat resistance is used for the substrate of the image transfer material. Examples of materials which can be used for the binder resin include: butyral resin; polyamide resin; polyethylene-imine resin; sulfonamide resin; polyester polyol resin; petroleum resin; homopolymers and copolymers of styrene and its derivatives and substitution products, such as styrene, vinyltoluene, α-methylstyrene, 2-methylstyrene, chlorostyrene, vinyl benzoic acid, vinylbenzene sulfonic soda, aminostyrene and the like; a homopolymer or a copolymer with another monomer of methacrylic acid esters such as methyl methacrylate, ethyl methacrylate, butyl methacrylate, hydroxyethyl methacrylate, and the like, and methacrylic acid, acrylic esters such as methyl acrylate, ethyl acrylate, butyl acrylate, α-ethylhexyl acrylate, and the like, and acrylic acid, dienes such as butadiene, isoprene and the like, acrylonitrile, vinyl ethers, maleic acid and maleic acid esters, maleic anhydride, and cinnamic acid, vinyl monomer such as vinyl chloride, vinyl acetate, and the like. Also, two or more of these resins may be mixed to be used.

An amount of pigment contained in the transfer layer is preferably from 30 to 70 wt %, and more preferably from 30 to 50 wt %. Further, an amount of resin contained in the transfer layer is preferably from 30 to 70 wt %, and more preferably from 50 to 70 wt %.

Further, in a case in which a plurality of image layers (transfer layers which form an image) are superposed on the image receiving material to produce a multi-color image, it is preferable for the transfer layer to contain a plasticizer, in order to enhance close contact between image layers. Examples of such plasticizers include: phthalic acid esters such as dibutyl phthalate, di-n-octyl phthalate, di (2-ethylhexyl) phthalate, dinonyl phthalate, dilauryl phthalate, butyl lauryl phthalate, butyl benzyl phthalate, and the like; an aliphatic dibasic acid ester such as di (2-ethylhexyl) adipate, di (2-ethylhexyl) sebacate, and the like; triester phosphates such as tricresyl phosphate, tri (2-ethylhexyl) phosphate, and the like; polyol polyesters such as polyethylene glycol ester and the like; and epoxy compounds such as a epoxy fatty acid ester or the like. Further, besides general plasticizers as mentioned above, polyethylene glycol dimethacrylate; 1, 2, 4-butanetriol trimethacrylate; acrylic esters such as trimethylolethane triacrylate, pentaerythritol triacrylate, pentaerythritol tetraacrylate, and dipentaerythritol-polyacrylate may also be suitably used, depending on the type of binder which is used. Further, a combination of two or more plasticizers may be used.

Image Receiving Material

The image receiving material which can be used for the method of the present invention includes an image receiving layer surface. The image receiving material may simply be a single image receiving layer, or may be a laminate having one or a plurality of image receiving layers provided on a substrate. In the case of a laminate having one or more image receiving layers provided on a substrate, the image receiving material can, as desired, have a structure in which any one, or two or more, of a cushion layer, a stripping layer, and an intermediate layer is provided between the substrate and the image receiving layer.

A variety of materials can be used as material for the image receiving layer of the image receiving material. Preferably, the material which forms the image receiving layer is selected in view of affinity with the aforementioned adhesive material. Examples of materials which can be used for forming the image receiving layer include a resin sheet of polyethylene terephthalate (PET) or the like, plain paper, coated paper, a glass epoxy sheet, a metallic plate, and the like. These can also form an image receiving material that is made from a single material.

In a case in which a thermoplastic material is used as the adhesive material, depending on the aforementioned processes above, it is preferable for materials that form the image receiving material to have heat resistance.

In a case in which the image receiving material has the image receiving layer provided on just one surface of the substrate, a back layer for improving transportability of the substrate may be provided on the surface opposite the surface on which the image receiving layer is provided.

Examples of substrates used for forming a laminate include sheets of ordinary base materials, such as a plastic sheet, a metallic sheet, a glass sheet, paper, and the like. Examples of plastic sheets include a polyethylene terephthalate sheet, a polycarbonate sheet, a polyethylene sheet, a polyvinyl chloride sheet, a polyvinylidene chloride sheet, a polystyrene sheet, a styrene-acrylonitrile sheet, a polyester sheet, and the like. Moreover, as a paper substrate, book printing paper, coated paper and the like can be used.

It is preferable if the substrate used in the laminate has small cavities (voids), because curling can be prevented and image quality can be improved. Such a substrate can be produced by, for example: mixing a thermoplastic resin with a filler, which is formed by at least one of a high polymer which is incompatible with the thermoplastic resin or the like and an inorganic pigment, to make a mixed melt; forming the mixed melt into a single-layered or multi-layered film with a melting extruder; and then stretching the obtained single-layered or multi-layered film monoaxially or biaxially. In this case, the void ratio is determined by resin and filler selection, mixing ratio, stretching conditions, and the like.

As a thermoplastic resin, a polyolefine resin such as polypropylene or the like, and polyethylene terephthalate resin are preferable because they have a good degree of crystallinity and good extensibility, and voids are easily formed therein. Preferably, a polyolefine resin or polyethylene terephthalate resin is used as a primary component and combined with an appropriate small amount of another thermoplastic resin. An inorganic pigment to be used as a filler preferably has an average particle size from 1 $\mu$m to 20 $\mu$m, and examples thereof include calcium carbonate, clay, diatom earth, titanium oxide, aluminum hydroxide, silica, and the like. Further, in a case in which polypropylene is used as the thermoplastic resin, it is preferable to use as the filler a polyethylene terephthalate which is a resin which is incompatible with the polypropylene in combination with the polypropylene.

Further, the amount of a filler, such as an inorganic pigment or the like, in the substrate is generally from 2 to 30% by volume.

Thickness of the substrate of the image receiving material is usually from 10 to 400 $\mu$m, and preferably from 25 to 200 $\mu$m. A surface treatment such as a glow discharge process, a corona discharge process, or the like may be applied to a surface of the substrate, in order to enhance adhesiveness between the substrate surface and the image receiving layer (or cushion layer) or adhesiveness between the substrate surface and the transfer layer.

Portions of the transfer layer, formed in an image pattern, are transferred via the image pattern forming material formed in an image pattern onto the surface of the image receiving material. Preferably, at least one image receiving layer is provided on the substrate to fix the portions of transfer layer formed in an image pattern. Preferably, the image receiving layer is a layer formed primarily of an organic polymer binder. This binder is preferably a thermoplastic resin. Examples of such organic polymer binders include homopolymers and copolymers of acrylic monomers such as acrylic acid, methacrylic acid, acrylic ester, methacrylic esters and the like; cellulosic polymers such as methylcellulose, ethylcellulose, and cellulose acetate; homopolymers and copolymers of vinyl monomers such as polystyrene, polyvinyl pyrrolidone, polyvinyl butyral, polyvinyl alcohol, polyvinyl chloride, or the like; condensation polymer such as a polyester, polyamide, and the like; and elastomeric polymers such as a butadiene-styrene copolymer. In view of improving adhesiveness between the image receiving layer and the transfer layer via the adhesive material at the time of adhesion and to improving efficiency of stripping and transfer, a binder polymer which is the same as or similar to the binder polymer of the transfer layer is particularly preferable as a binder polymer used for the image receiving layer.

In a case in which an image receiving layer is included, thickness of the image receiving layer is from 0.3 to 7 $\mu$m, and preferably from 0.7 to 4 $\mu$m.

The image forming method of the present invention can be performed using an image forming apparatus which will be described below. This image forming apparatus will be described with reference to FIG. 2.

Figure 2:
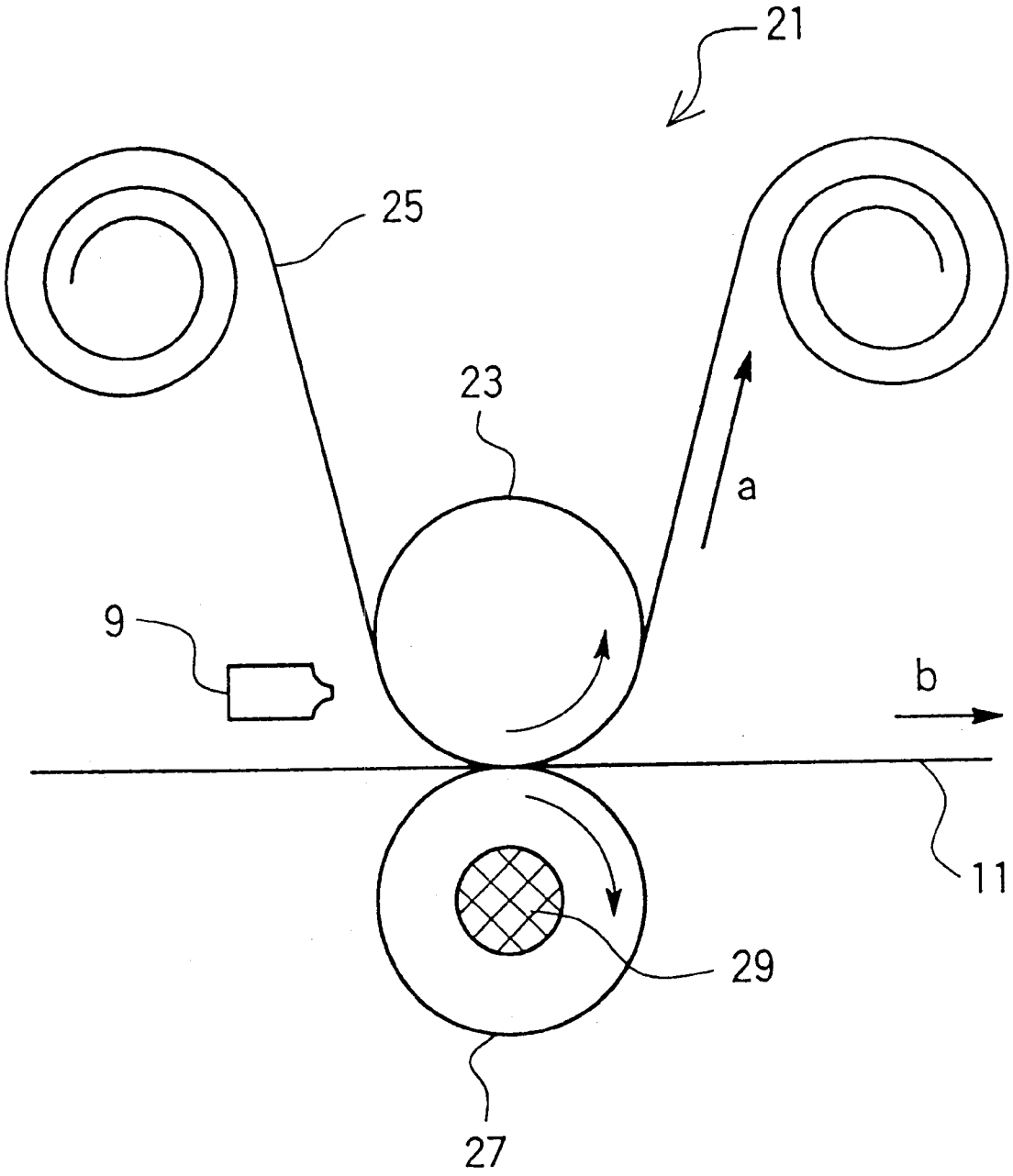
FIG. 2 is a drawing illustrating one aspect of an image forming apparatus which implements the image forming method of the present invention.

FIG. 2 is a conceptional view which illustrates a structure of an image forming apparatus of the present invention.

A supporting drum 23 is provided in an image forming apparatus 21. The supporting drum 23 supports a transfer material (toner sheet) 25, in which a transfer layer is provided on a substrate, such that the transfer material 25 is wound around a part of an outer periphery of the supporting drum 23. The rotational direction of this supporting drum 23 is a main scanning direction for forming an image.

The transfer material 25 is supported by the supporting drum 23 in a manner such that a substrate surface side of the transfer material 25 is in contact with the supporting drum 23 and a transfer layer surface side of the transfer material 25 serves as a front surface. A pinch roller 27 is disposed such that an axis thereof is in a direction parallel to an axis of the supporting drum 23. Further, in a case in which a thermoplastic material is used as an adhesive material, a heater 29 may be integrated inside the pinch roller 27.

A droplet discharging head 9 is disposed so as to be able to discharge an image pattern forming material toward the surface of the image transfer material 25. Specifically, for the apparatus illustrated in FIG. 2, a case in which the image pattern forming material is discharged onto the surface of the image transfer material is described. The droplet discharging head 9 is supported such that the droplet discharging head 9 can be moved freely in a direction perpendicular to the surface of the drawing which is FIG. 2 via a moving rail or the like. The movement direction of this droplet discharging head 9 is a sub-scanning direction for forming an image. The droplet discharging head 9 is disposed such that droplets of the image pattern forming material containing the adhesive material are discharged in an image pattern and form a latent image on the transfer layer surface of the transfer material 25 supported by the supporting drum 23. A well-known ink head structure can be used for structure of this droplet discharging head 9.

Hence, the image pattern forming material is discharged from the droplet discharging head 9 and (although not illustrated) the image pattern forming material is formed in an image pattern on the surface of the image transfer material 25.

Next, an image receiving material 11 and the image transfer material 25 are moved to be inserted between the supporting drum 23 and the pinch roller 27. When inserted between the supporting drum 23 and the pinch roller 27, the image receiving material 11 and the image transfer material 25 are subjected to a predetermined pressure from the supporting drum 23 and the pinch roller 27, and the image transfer material 25 and the image receiving material 11 adhere to each other through the image pattern forming material which was formed in an image pattern. At this time, if a thermoplastic material is used as the adhesive material contained in the image pattern forming material, heat may be applied from the heater 29 disposed inside this pinch roller 27 to adhere the image transfer material 25 to the image receiving material 11. Next, the structure of the image forming apparatus 21 is such that the image transfer material 25 and the image receiving material 11 are moved, toward the right in FIG. 2, by rotation of the supporting drum 23 and the pinch roller 27.

The image transfer material 25 which has passed through the gap between the supporting drum 23 and the pinch roller 27 is moved in the direction of arrow a by an unillustrated winding means or the like disposed at the upper right side of FIG. 2. Meanwhile, the image receiving material 11 is moved in the direction of arrow b by an unillustrated winding means or the like disposed at the right side of FIG. 2. Because the image transfer material 25 moves in the direction of arrow a and the image receiving material 11 moves in the direction of arrow b, the image transfer material 25 and the image receiving material 11 are peeled apart. At this time, portions of the transfer layer of the image transfer material 25 that have adhered to the image receiving layer surface of the image receiving material 11 via the image pattern forming material, which was formed in an image pattern, are stripped off from the transfer layer of the image transfer material 25 and transferred to the receiving surface of the image receiving material 11. The transferred portions of the transfer layer are the image. Hence, the image is formed.

Although the image forming apparatus has been described with reference to FIG. 2, an image forming apparatus in accordance with the present invention is not limited to the same. For example, an image forming means may include a means which discharges an image pattern forming material containing an adhesive material to either a transfer layer sur face of an image transfer material or an image receiving layer surface of an image receiving material, a means in which the transfer layer surface of the image transfer material and the receiving surface of the image receiving material are closely contacted to each other by the image pattern forming material formed in an image pattern, and a means which peels off the image transfer material from the image receiving material and strips off portions of the transfer layer in an image pattern via the image pattern forming material formed in an image pattern to form an image on the image receiving material.

Further, in a case in which a thermoplastic material is used as an adhesive material, it is preferable that a heating means is provided. This heating means, as illustrated in FIG. 2, may be disposed such that heat is applied while the transfer layer surface of the image transfer material and the image receiving layer of the image receiving material are closely contacted to each other, or may be disposed such that heat is applied before or after the image transfer material and the image receiving layer of the image receiving material are closely contacted to each other.

Further, in FIG. 2, the droplet discharging head is disposed such that a droplet discharging direction is horizontal; i.e., droplets are directed to the image transfer material. However, the droplet discharging head may be disposed such that the droplet discharging direction is vertical; i.e., the droplets are directed to the image receiving material.

EXAMPLES

The present invention will be explained below by examples, but the present invention is not limited to the same. In the examples below, unless indicated otherwise, "%" signifies percentage by weight and "parts" signifies parts by weight.

Example 1

Production of Image Transfer Material

The following components were dispersed thoroughly and a coating solution for a transfer layer was prepared.

| | |
|---|---|
| Polyvinyl butyral | 8.5% |
| Pigment | 5.4% |
| Wax | 1.5% |
| Propanol | 42.3% |
| Methyl ethyl ketone | 42.3% |

As a substrate of the image transfer material, polyethylene terephthalate having a thickness of 4.5 $\mu$m, wherein a releasing processing had been applied to the back surface thereof, was employed. The above-described coating solution for the transfer layer was applied using a rotational applicator, a transfer layer having a film thickness of 0.5 $\mu$m was formed, and an image transfer material A-1 was produced.

Preparation of Image Pattern Forming Material

AQUATEX EC-1200 (made by Mitsubishi Chemical Corporation), which contains an ethylene-vinyl acetate copolymer resin as an adhesive material, was used as an image pattern forming material B-1. AQUATEX EC-1200 contained 50% of the ethylene-vinyl acetate copolymer resin in solid form and water was used as a dispersion medium. AQUATEX EC-1200 had characteristics such as a viscosity of 90 cps at a temperature of 23° C. and a pH of 5.5, and the like. These characteristics are recited in Table 1.

Image Receiving Material

As an image receiving material, ordinary paper (referred to as "image receiving material C-1") was used alone. The receiving surface of this general paper was hydrophilic and had moderate roughness.

Image Forming

The above-described image pattern forming material B-1 was discharged onto the image receiving material C-1 using a droplet discharging head, which was the same as that used in the image forming apparatus illustrated in FIG. 2. The image pattern forming material B-1, formed in an image pattern on the image receiving material C-1, was dried. After the obtained image receiving material C-1 was closely contacted to the image transfer material A-1, this closely contacted body was laminated under conditions in which temperature was 90° C., pressure was 0.5 kgf/cm$^2$, and velocity was 1 m/min. After that, the laminated and adhered body was cooled to room temperature and the image receiving material C-1 was stripped off from the image transfer material A-1. As a result of stripping, an image was formed on the image receiving material C-1.

Examples 2 through 14

Image forming was performed using processes which were the same as in Example 1. However, in Examples 2 through 14, instead of the image pattern forming material B-1, image pattern forming materials B-2 through B-14, listed in Table 1, were used.

TABLE 1

| Sample | Adhesive Material | Dispersion Medium | Solid Content (%) | Viscosity | Tg (° C.) | Remarks |
|---|---|---|---|---|---|---|
| B-1 | Ethylene-vinyl acetate copolymer resin | Water | 50 | <100 mPa · s (25° C.) | 60 | AQUATEX EC-1200 (made by Mitsubishi Chemical Corporation) |
| B-2 | Ethylene-methacrylate copolymer resin | Water | 45 | <100 mPa · s (25° C.) | 90 | AQUATEX AC-3100 (made by Mitsubishi Chemical Corporation) |
| B-3 | Ethylene-vinyl acetate copolymer resin | Water | 50 | <200 mPa · s (25° C.) | 60 | AQUATEX EC-1700 (made by Mitsubishi Chemical Corporation) |
| B-4 | Ethylene-vinyl acetate copolymer resin | Water | 45 | <200 mPa · s (25° C.) | 85 | AQUATEX EC-4400 (made by Mitsubishi Chemical Corporation) |
| B-5 | Olefin copolymer resin | Water | 50 | <500 mPa · s (25° C.) | 60 | AQUATEX EC-3500 (made by Mitsubishi Chemical Corporation) |
| B-6 | Carnauba Wax | Water | 31.5 | 149 | 80 | AQUATEX CC-1003 (made by Mitsubishi Chemical Corporation) |
| B-7 | AE-8750 | Water | 35 | 40BF Viscosity mPa · s | — | COLLOIDAL DISPERSION AE-8750 (made by Japan Synthetic Rubber) |
| B-8 | Ethylene-vinyl acetate copolymer resin | Water | 10 | — | | The aforementioned B-1, diluted by five times with water |
| B-9 | Ethylene-methacrylate copolymer resin | Water | 9 | — | | The aforementioned B-2, diluted by five times with water |
| B-10 | Ethylene-vinyl acetate copolymer resin | Water | 10 | — | | The aforementioned B-3, diluted by five times with water |
| B-11 | Ethylene-vinyl acetate copolymer resin | Water | 9 | — | | The aforementioned B-4, diluted by five times with water |
| B-12 | Olefin copolymer resin | Water | 10 | — | | The aforementioned B-5, diluted by five times with water |
| B-13 | Carnauba Wax | Water | 6.3 | — | | The aforementioned B-6, diluted by five times with water |
| B-14 | AE-8750 | Water | 7 | — | | The aforementioned B-7, diluted by five times with water |

Examples 15 through 28

In Example 15, image forming was performed using processes which were the same as in Example 1. However, instead of the image receiving material C-1, polyethylene terephthalate having a thickness of 100 $\mu$m ("image receiving material C-2") was used.

Further, in Examples 16 through 28, the image pattern forming materials B-2 through B-14 listed in Table 1 were used in place of the image pattern forming material B-1 used in Example 15.

Materials used for image forming in Examples 1 through 28 and results thereof are summarized in Table 2.

As is apparent from Table 2, good images could be obtained with Examples 1 through 28.

Example 29

In Example 29, image forming was attempted using materials and processes which were the same as those in Example 1, except that the laminating process was. performed at a temperature of 50° C. However, in Example 29, transferability was somewhat insufficient relative to Examples 1 to 28.

TABLE 2

| Example No. | Image Transfer Material | Image Pattern Forming Material | Image Receiving Material | Quality of Image |
|---|---|---|---|---|
| Example 1 | A-1 | B-1 | C-1 | satisfactory |
| Example 2 | A-1 | B-2 | C-1 | satisfactory |
| Example 3 | A-1 | B-3 | C-1 | satisfactory |
| Example 4 | A-1 | B-4 | C-1 | satisfactory |
| Example 5 | A-1 | B-5 | C-1 | satisfactory |
| Example 6 | A-1 | B-6 | C-1 | satisfactory |
| Example 7 | A-1 | B-7 | C-1 | satisfactory |
| Example 8 | A-1 | B-8 | C-1 | satisfactory |
| Example 9 | A-1 | B-9 | C-1 | satisfactory |
| Example 10 | A-1 | B-10 | C-1 | satisfactory |
| Example 11 | A-1 | B-11 | C-1 | satisfactory |
| Example 12 | A-1 | B-12 | C-1 | satisfactory |
| Example 13 | A-1 | B-13 | C-1 | satisfactory |
| Example 14 | A-1 | B-14 | C-1 | satisfactory |
| Example 15 | A-1 | B-1 | C-2 | satisfactory |
| Example 16 | A-1 | B-2 | C-2 | satisfactory |
| Example 17 | A-1 | B-3 | C-2 | satisfactory |
| Example 18 | A-1 | B-4 | C-2 | satisfactory |
| Example 19 | A-1 | B-5 | C-2 | satisfactory |
| Example 20 | A-1 | B-6 | C-2 | satisfactory |
| Example 21 | A-1 | B-7 | C-2 | satisfactory |

TABLE 2-continued

| Example No. | Image Transfer Material | Image Pattern Forming Material | Image Receiving Material | Quality of Image |
|---|---|---|---|---|
| Example 22 | A-1 | B-8 | C-2 | satisfactory |
| Example 23 | A-1 | B-9 | C-2 | satisfactory |
| Example 24 | A-1 | B-10 | C-2 | satisfactory |
| Example 25 | A-1 | B-11 | C-2 | satisfactory |
| Example 26 | A-1 | B-12 | C-2 | satisfactory |
| Example 27 | A-1 | B-13 | C-2 | satisfactory |
| Example 28 | A-1 | B-14 | C-2 | satisfactory |

In accordance with the present invention, the range of materials usable for an image forming method employing an ink-jet technique is widened, and reduction of developing process steps or the like and omission of a cleaning fluid and the like used in that process are made possible. Further, in accordance with the present invention, a stripping transfer technique image forming method can be achieved which carries out stripping and transfer with high efficiency and yields an image with high image quality and high homogeneity.

What is claimed is:

1. A method of forming an image comprising the steps of:

(a) discharging an image pattern forming material containing at least one kind of adhesive material comprising a thermoplastic material, which has a glass transition point and softens and becomes adhesive when heated to a temperature at least equal to the glass transition point but no more than 100 degrees C. greater than the glass transition point, in accordance with image data onto one of a transfer layer surface of a transfer material and an image receiving layer surface of an image receiving material;

(b) close contacting the transfer layer surface and the image receiving layer surfaces against one another; and (c) peeling off one surface from the other and portions of the transfer layer along therewith due to the effect of the adhesive material, thereby forming an image on the image receiving material.

2. The method of claim 1, wherein the adhesive material is dispersed in solid form.

3. The method of claim 1, wherein the adhesive material includes a material having adhesiveness.

4. The method of claim 1, the method further comprising the step of heating to a temperature in a range at least equal to the glass transition point and to no more than 100 degrees C. greater than the glass transition point.

5. The method of claim 4, wherein the step of heating is performed during the step of close contacting.

6. The method of claim 1, wherein the adhesive material includes at least one copolymer resin selected from the group consisting of ethylene-vinyl acetate copolymer resins, ethylene-methacrylic acid copolymer resin, and olefin copolymer resins.

7. The method of claim 1, wherein the adhesive material comprises from 0.1 to 100 percent by weight of the image pattern forming material.

8. The method of claim 1, wherein the transfer layer is formed on one surface or both surfaces of a substrate, and the transfer layer contains polyvinyl butyral.

9. A method of forming an image comprising the steps of:

(a) disposing a substance comprising a thermoplastic material, which has a glass transition point and softens and becomes adhesive when heated to a temperature at least equal to the glass transition point but no more than 100 degrees C. greater than the glass transition point, in accordance with image data on a first material to thereby form a first image on the first material;

(b) adhering portions of the first material in accordance with the first image, to a second material; and (c) transferring said portions from one material to the other material to thereby form a second image, which is a visible image, on said other material.

10. The method of claim 9, wherein the step of adhering portions includes close contacting the first material against the second material and applying heat.

11. The method of claim 9, wherein the step of transferring said portions, includes peeling off the one material from the other material.

12. The method of claim 9, wherein the step of disposing a substance, includes providing a substance comprising at least one adhesive material.

13. A method of forming an image comprising the steps of:

(a) disposing a substance including at least one adhesive material comprising a thermoplastic material, which has a glass transition point and softens and becomes adhesive when heated to a temperature at least equal to the glass transition point but no more than 100 degrees C. greater than the glass transition, in accordance with image data on a first material to thereby form a first image on the first material;

(b) close contacting the first material against the second material; and (c) peeling off one material from the other and portions from one material in accordance with the first image, to thereby form a second image, which is a visible image, on one of the materials.

* * * * *